United States Patent [19]

Kholmogorov et al.

[11] 4,045,991

[45] Sept. 6, 1977

[54] AUTOMATIC FORGE ROLLING MACHINE

[76] Inventors: Mikhail Vladimirovich Kholmogorov, ulitsa Trofimova, 20, kv. 50; Jury Vasilievich Katkov, 3 linia, 11, korpus 2, kv. 63; Grigory Vasilievich Vorbiev, Proletarsky prospekt, 23, korpus 1, kv. 131; Alexandr Mikhailovich Gusev, Chernomorsky bulvar, 15, korpus 2, kv. 124; Eduard Gurgenovich Nazaretian, 1 ulitsa Mashinostroenia, 10, kv. 6, all of Moscow, U.S.S.R.

[21] Appl. No.: 753,289

[22] Filed: Dec. 22, 1976

[51] Int. Cl.[2] ..... B21B 39/06

[52] U.S. Cl. ..... 72/251; 72/422; 198/339

[58] Field of Search ..... 72/251, 422, 423, 428, 72/87; 198/339, 732; 72/133

[56] References Cited

U.S. PATENT DOCUMENTS

| | | | |
|---|---|---|---|
| 2,620,690 | 12/1952 | Preston | 72/251 X |
| 3,443,414 | 5/1969 | Kull et al. | 72/422 |

*Primary Examiner*—Milton S. Mehr
*Attorney, Agent, or Firm*—Fleit & Jacobson

[57] ABSTRACT

An automatic forge rolling machine relates to metal-working equipment. The present invention can be most advantageously used for rolling workpieces prior to finish forging in mass production of various parts and articles.

The herein proposed forge rolling machine comprises two stands each accommodating two shafts carrying roll-forging dies and a means for feeding a workpiece to said dies, said means being provided with a guide for the workpiece and a conveyer having a hauling member which carries a pusher for advancing said workpiece, and means for braking the workpiece before it is engaged by the roll-forging dies.

A braking member of the braking means is disposed substantially above the guide means for advancing the workpiece being worked, said braking member being spring-biased towards the workpiece. The mechanism for tensioning the hauling member, carrying the pusher of the conveyer, is positioned behind the roll forging dies, as viewed in the direction of the workpiece travel, and is made so that the tensioning of the hauling member is maintained constant in the direction of the workpiece travel, thereby providing accuracy of an initial position of the pusher ahead of the workpiece braking means. Such an arrangement prevents self-feeding of the workpiece to the dies and enables the workpiece to be fed to the latter at prescribed time intervals, thereby ensuring high quality of the finished product.

3 Claims, 9 Drawing Figures

AUTOMATIC FORGE ROLLING MACHINE

The present invention relates to metal working equipment, and more particularly to automatic forge rolling machines.

The invention is especially well suited to application for rolling workpieces prior to finish stamping in mass production of various machine parts and articles.

There is known an automatic forge rolling machine comprising a bed with stands mounted thereupon. Each stand accommodates two shafts carrying on their free ends a pair of roll-forging dies, arranged one above the other and a means for feeding a workpiece thereto. The aforesaid means is provided with a guide for the workpiece travel and a conveyer kinematically associated with one of the shafts and provided with a hauling member. The conveyer hauling member is provided with a tensioning mechanism and a pusher for moving the workpiece along the guide.

Each stand also accommodates a means for braking the workpiece before it is engaged by the dies. For the sake of brevity, the automatic forge rolling machine of the invention will be herein below referred to as the forge machine.

In such a forge machine each means for braking down the workpiece is made as a pair of wedges rigidly fixed opposite each other on a corresponding roll-forging die and occupies a part of its surface area. This rules out the possibility of utilizing the entire circumferential area of the die and significantly reduces efficiency of the forge machine.

In addition, due to the hereinbefore described construction of said braking means the workpiece may easily slip by inertia into a gap between the roll forging dies prior to their assuming an initial position required to commence roll-forging operation. Thus, the accuracy of feeding the workpiece to the dies is impaired and unfavourable conditions for obtaining the machine parts of a prescribed profile are created to result in the defective finished product. In addition, under certain circumstances these roll forging dies may get jammed, which in turn, may lead to emergency. To eliminate the possibility of emergency, it is necessary to stop and reset the forge machine. The hauling member of the conveyer, for instance the pusher-carrying chain, elongates as it is heated by hot workpieces and wears out. The elongated chain is retensioned periodically with the aid of the mechanism mounted on the end portion of the conveyor near the inlet of the forge machine through which passes the workpiece. Said mechanism is made as a pair of screws driven into the ends of the sliding axle of the conveyer driven member, in this particular case a sprocket. With their free ends the screws are thrust up against the conveyor frame. The screws are adjusted manually and their position is fixed by locknuts.

Said adjusting makes for alternation of an axial clearance of the floating and fixed sprockets of the conveyer, as well as changes the axle position of the floating sprocket, which is a driven one, in relation to the roll shafts with forging dies, i.e. the distance between said axle and the roll forging dies. When in its initial position, the pusher is arranged or located above the floating driven sprocket substantially along its geometric vertical axis. Therefore, the change in position of the driven sprocket with respect to the roll forging dies changes the initial position of the pusher in relation to said dies, i.e., the distance between the pusher and the roll dies. As a result, the time period necessary for delivering the workpiece, starting from the moment when the latter is gripped by the pusher upto the moment of its entering the roll forging dies, is likewise changed. The accuracy of feeding the workpiece to the roll dies is thus impaired and, consequently, the quality of the finished product.

It is a primary object of the invention to eliminate the possibility of the workpiece self-feeding to roll forging dies.

A further object of the invention is to provide feeding of a workpiece to roll forging dies at a prescribed time interval.

Still another object of the invention is to expand technological possibilities of a forge rolling machine.

These and other objects and features of the invention are accomplished by the provision of an automatic forge rolling machine comprising a bed with stands mounted thereon, each stand accommodating two roll shafts carrying on their free ends a pair of roll forging dies arranged one above the other, a means for feeding a workpiece to said dies, said means being provided with a guide for the workpiece travel and a conveyor with a hauling member kinematically associated with one of said shafts, said conveyer being provided with a mechanism for tensioning said hauling member and a pusher for moving the workpiece along the guide, and means for braking the workpiece before it is engaged by said roll forging dies. According to the invention, each of the workpiece braking means is arranged ahead of a pair of the roll forging dies and its braking element is positioned substantially above the guide and spring-biased towards the latter, the conveyer hauling member tensioning mechanism being arranged behind the roll forging dies in the direction of the workpiece travel and made so that the tensioning of the hauling member is maintained constant in the direction of the workpiece travel, thereby providing accuracy of an initial position of the pusher ahead of said workpiece braking means.

Such an arrangement permits of retarding the workpiece before the roll forging dies prior to its interaction with the pusher which delivers the workpiece to said dies at a prescribed time interval, thus preventing self-feeding of the workpiece to the dies, which, in turn, precludes defects in and improves quality of the articles being produced.

In addition, such constructional arrangement enables the entire surface of the dies to be used for roll forging the workpiece and thereby to considerably expand technological possibilities of the herein proposed forge rolling machine. The location of the mechanism for tensioning the conveyer hauling member behind the die assembly provides for a fixed initial position of the pusher, which results in that the pusher and the workpiece commence to cooperate at a predetermined time period and the workpiece is fed to the roll forging dies with due accuracy.

Such constructional arrangement, in combination, provides for a prescribed accuracy of the finished product.

It is expedient that a braking element be made in the form of a plate whose one end is pivoted on the machine stand, the free end thereof being spring-biased towards the guide.

Such an arrangement allows for reliable retarding of the workpiece before it is advanced by the pusher to the roll forging dies, said braking element being simple enough in structure.

It is also preferable that the conveyer hauling member tensioning mechanism be provided with a yoke carrying a driven member of the conveyer and mounted on its frame for reciprocated movement therealong by means of guide rams rigidly fixed to the yoke face and having at their free ends thrust washers, compression springs mounted in the conveyer frame parallel to the guide rams and each thrusting up with one end thereof against the yoke face, and with the other one against the end of the aligned screw driven in the shaped nut loosely set in the slot fitted in the conveyer frame perpendicular to the axes of said rams.

Such constructional arrangement enables both runs of the conveyer hauling member to be uniformly tensioned. The elongation of the hauling member due to wear and heat is compensated for by the compression springs of said mechanism. As a consequence, a required initial position of the pusher is maintained constant in relation to the roll forging dies with the workpiece being fed thereto at predetermined time intervals. In addition, the provision of thrust washers on the free ends of the guide rams enables the driven member of the conveyer to be held in place on its frame in case of rupture of the conveyer hauling member, which improves the operating reliability of the forge rolling machine of the invention. Said tensioning mechanism is simple in operation and easy to mount, this being important time-saving factor during its repair, i.e., replacing the mechanism springs being its most important components which carry the greatest load created by the tension of the hauling member during operation of the forge rolling machine.

The invention will now be described in greater detail with reference to a specific embodiment thereof, taken in conjunction with the accompanying drawings. In the drawings.

Figure 1:
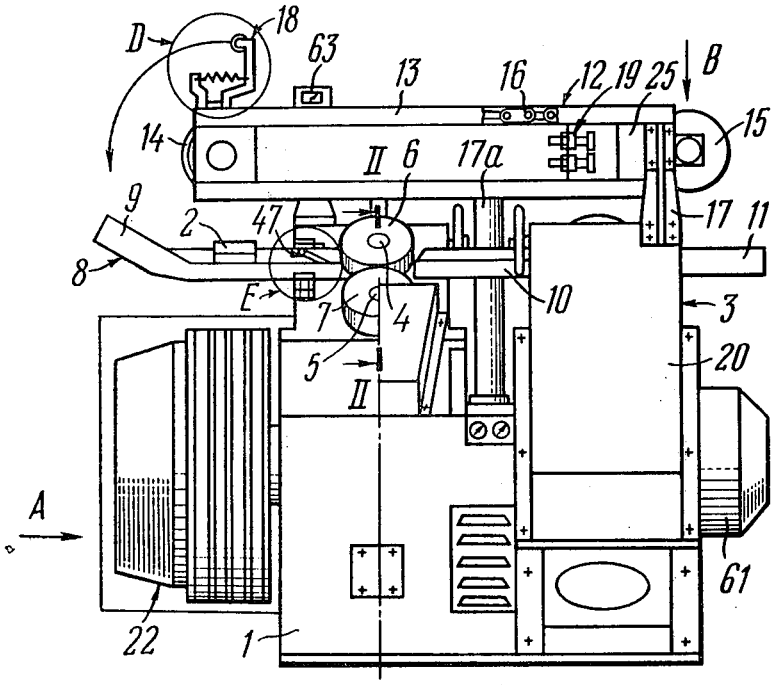
FIG. 1 is a schematic front view of an automatic forge rolling machine in accordance with the invention.

Referring now to the drawings and to FIG. 1 in particular, there is shown therein an automatic forge rolling machine which comprises a bed 1 mounting thereupon one after the other, in the direction along which a workpiece 2 undergoes processing, two stands 3.

Each stand 3 accommodates two roll shafts 4 and 5, each carrying on its free end a pair of roll forging dies 6 and 7. Arranged or located adjacent the stand 3 is a means for feeding the workpiece 2 to the dies 6 and 7. Said means has a guide way 8 for the workpiece 2 to move therealong, said guide way being made in the form of a chute which consists of sections 9, 10 and 11.

The chute sections 9, 10 and 11 are arranged or located one after another, as viewed in the direction along which the roll forging is carried out.

The first section 9 of the chute is positioned ahead of the first pair of the dies 6 and 7, as viewed in the direction of the technological process.

The second section 10 of the chute is positioned intermediate the first and the second pairs of the dies 6 and 7.

The third section 11 of the chute is positioned behind the second pair of the dies 6 and 7. All the chute sections 9, 10 and 11 are rigidly fixed on the stands 3 and are arranged substantially on the level of the mating line of the dies 6 and 7, such as shown in FIG. 1.

Arranged or mounted in parallel to and above the chute is a conveyer 12 which possesses a frame 13, carrying the conveyer driven and drive members in the form of sprockets 14 and 15 enveloped by a hauling member 16 in the form of a chain. The frame 13 of the conveyer 12 is rigidly fixed on the stands 3 by means of brackets 17 and on the bed 1 by means of a prop 17*a*, such as shown in FIG. 1. The drive sprocket 14 is mounted by conventional means on the end of the frame 13, disposed above the first section 9 of the chute. The driven sprocket 15 is mounted by conventional means on the other end of the frame 13, disposed above the third section 11 of the chute.

Mounted on the hauling member 16 is a pusher 18 for moving the workpiece 2 along the guide way 8.

In addition, the hauling member 16 of the conveyer 12 is provided, according to the invention, with a mechanism 19 for tensioning the latter. Said mechanism 19 is mounted on the frame 13, such as shown in FIG. 1, and carries the driven sprocket 15.

Figure 2:
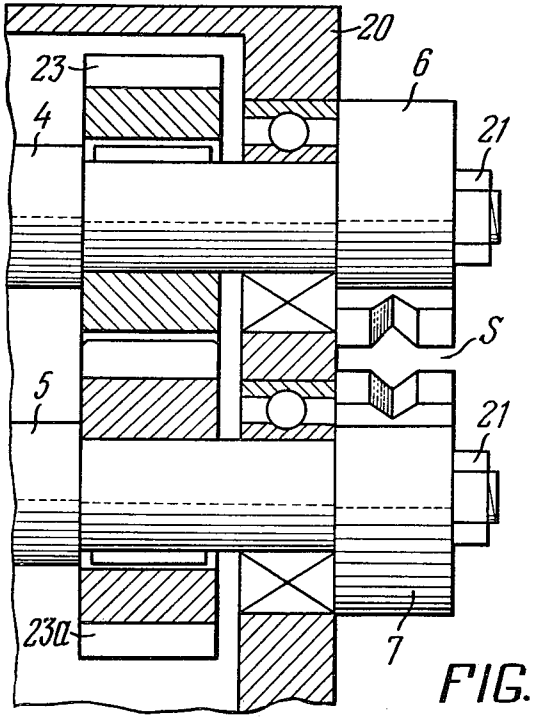
FIG. 2 is a cross-section along line II—II of FIG. 1, on a larger scale.

Each stand 3 has a housing 20 accommodating the roll shafts 4 and 5 which are mounted one above the other, such as shown in FIG. 2, said shafts kinematically associating with each other.

Each of the roll forging dies 6 and 7 is mounted on the free end of the shafts 4 and 5 respectively, so that said dies 6 and 7 are arranged one above the other forming therebetween a gap S for the workpiece 2 to be advanced therein for processing.

The roll forging dies 6 and 7 are secured on the roll shafts 4 and 5 by means of nuts 21, such as shown in FIG. 2. The roll shaft 5 is a drive shaft and may be kinematically associated with a common drive 22 (FIG. 1) of the forge machine in a conventional manner which is not herein disclosed for the sake of clarity of the invention. The kinematic association between the roll shafts 4 and 5 is effected though a pinion 23 (FIG. 2) rigidly secured on the shaft 4 and a pinion 23*a* rigidly secured on the shaft 5 and meshed with the pinion 23.

Figure 3:
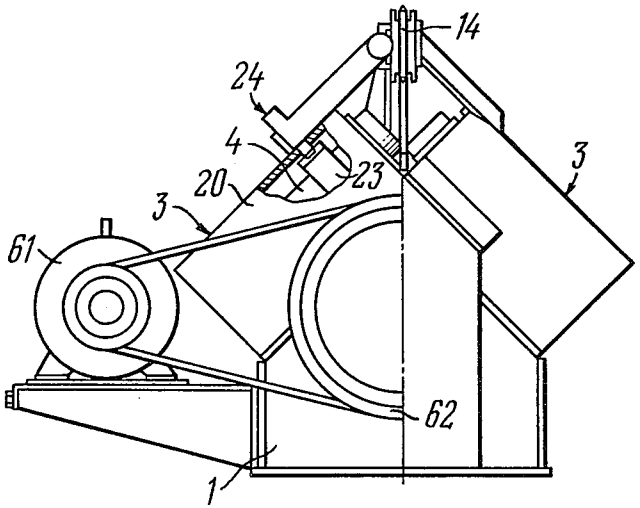
FIG. 3 is a view taken in the direction of arrow A in FIG. 1.
Figure 4:
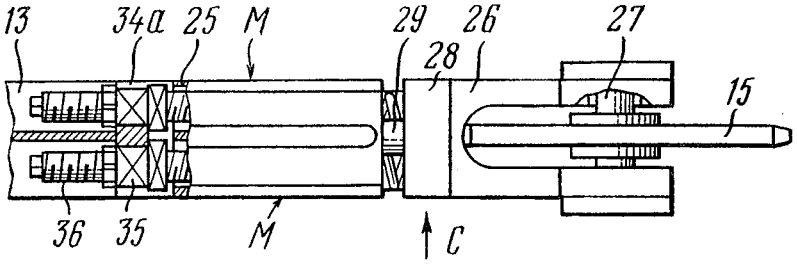
FIG. 4 is a view taken in the direction of arrow B in FIG. 1.
Figure 5:
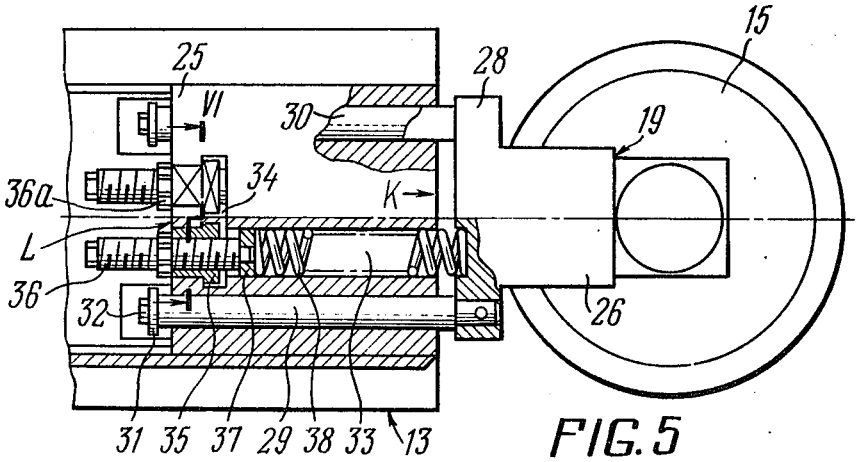
FIG. 5 is a view taken in the direction of arrow C in FIG. 4.
Figure 6:
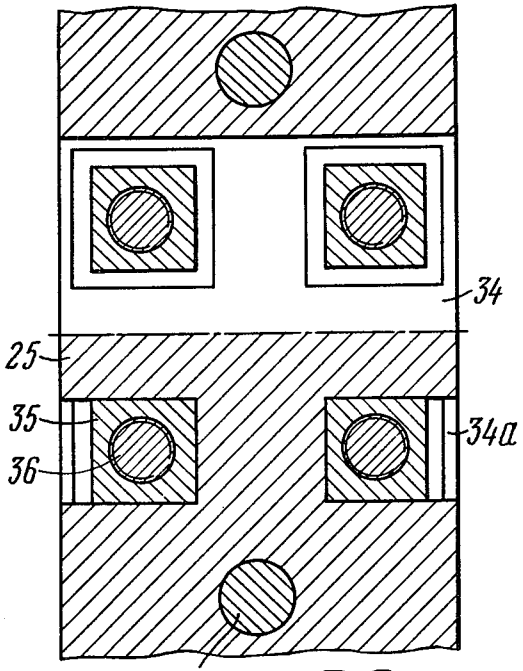
FIG. 6 is a cross-section along line IV—IV of FIG. 5, on a larger scale.

The drive sprocket 14 (see FIG. 1) is kinematically associated with the shaft 4 mounted within the first stand 3, as viewed in the direction of the technological process. This type of kinematic association is effected through the pinion 23 (see FIG. 3) and a reducer 24 coupled with the pinion 23 through its inlet link. The reducer 24 is mounted on the housing 20 of the stand 3. An outlet link of the reducer 24 is kinematically linked through bevel pinions (unshown) with the drive sprocket 14. In accordance with the invention, the mechanism 19 (FIG. 1) for tensioning the hauling member 16 of the conveyer 12 is arranged or located behind the second pair of the roll dies 6 and 7 and is mounted on the end of the frame 13, formed by a cross-piece 25, such as shown in FIG. 1. The mechanism 19 possesses a yoke 26 (FIG. 4), which is mounted in the cross-piece 25 for reciprocated movement along the frame 13. Freely mounted in the yoke 26 is an axle 27 carrying the driven sprocket 15. The yoke 26 is formed with a flange 28. Whereupon are secured near its edges two parallel rams 29, such as shown in FIG. 5. The cross-piece 25 is formed with two openings 30 through which extend free ends of said rams 29, such as shown in FIG. 5. Secured on the face of the free end of each ram 29 is a washer 31 fixed by a bolt 32. The cross-piece 25 is formed with four more openings 33 arranged or located in the interspace between the openings 30. Said openings 33 are arranged in pairs and in two rows. In addition, the cross-piece 25 is fitted near the end L with a rectangular through slot 34 extending perpendicular to and traversing the openings 33, such as shown in FIGS. 4 and 5. Formed in the lateral sides M of the cross-piece 25 are rectangular notches 34*a* each of which is coaxial with one of the openings 33. Accommodated within each notch is a shaped nut 35. In cross-section the shaped nut 35 (see FIG. 6) has external rectangular profile. At the end facing the yoke 26, the nut 35 has a flange of a rectangular profile. A screw 36 is screwed in each nut 35. A free end of each screw 36 sits in the opening 33 and is capped by a washer 37 (FIG. 5). Each screw 36 is locked by a nut 36*a*. Mounted in each opening 33 between the washer 37 and the face K of the yoke 26 is a compression spring 38 for tensioning the hauling member 16.

Figure 7:
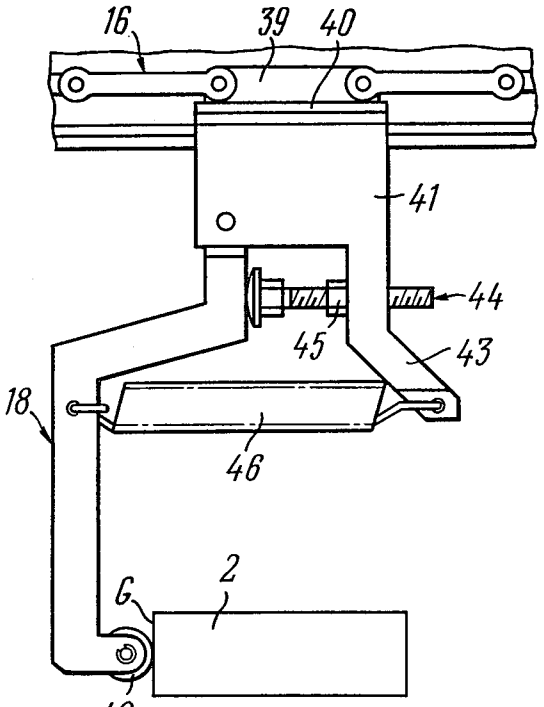
FIG. 7 is an enlarged view of the unit D shown in FIG. 1, a pusher being in its lower position.

The hauling member or chain 16 (FIG. 7) has a link 39 formed with a flange 40 whereupon is affixed a bracket 41 carrying the pusher 18. The pusher 18 is made as a rod of rectangular cross-section, bended such as shown in FIG. 7. The upper end of the pusher 18 is hinged on the bracket 41, and its lower end is fitted with a roller 42. The bracket 41 has a shank 43. To adjust the position of the pusher 18 in the process of setting the forge rolling machine for a desired size and type of the workpiece 2, the bracket 41 is fitted with an adjustable stop 44 in the form of a bolt with a profiled head, screwed into a threaded bore in the middle part of the shank 43, as shown in FIG. 7.

The head of the stop 44 is hexahedron in cross-section, its end being semi-spheric in shape, as shown in FIG. 7. The stop 44 is fixed in position by a locknut 45 screwed thereon.

Fixed by one end to the face of the shank 43 is a compression spring 46, the other end thereof being affixed on the pusher 18. The pusher 18 is pressed by means of the compression spring 46 against the stop 44, as shown in FIG. 7.

In accordance with the invention, arranged or located ahead of each pair of the roll dies 6 and 7 is a means 47 for braking the workpiece 2.

Figure 8:
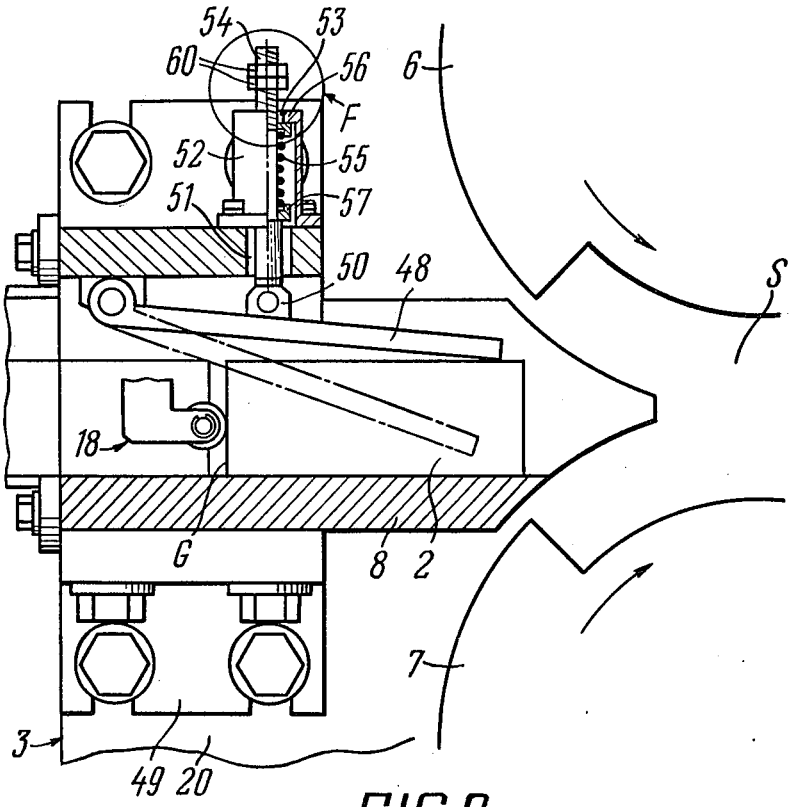
FIG. 8 is an enlarged view of the unit E shown in FIG. 1, according to the invention.
Figure 9:
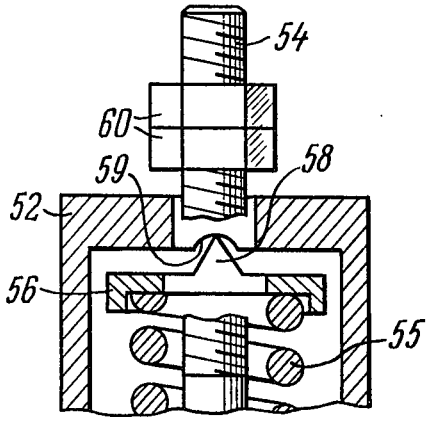
FIG. 9 is an enlarged view of the unit F shown in FIG. 8.

The means 47 comprises a breaking element in the form of a gib 48 such as shown in FIG. 8. The gib 48 is arranged or located above and along the chute, having its one end pivoted in the bracket 49 which is rigidly fixed by any conventional means on the housing 20 of the stand 3. The free end of the gib 48 faces the roll dies 6 and 7 and is spring-biased towards the chute so that the plate 48 is caused to assume inclined position. For this purpose, formed in the middle of the plate 48 is an eye element 50. The bracket 49, in turn, is fitted with a hole 51, and coaxially with said hole there is secured on the bracket 49, such as shown in FIG. 8, a casing 52 in the form of a cylinder with the bottom thereof turned upside down (in the plane of drawing of FIG. 8), said cylinder bottom being formed with a hole 53 coaxial with the hole 51. Extending through the holes 51 and 53 is a rod 54 pivotally connected to the eye element 50 of the gib 48. The rod 54 is made corbelled and its free end is threaded, the diameter of the latter being smaller than that in any other part of said rod. Fitted on the rod 54 is a compression spring 55 and shaped washers 56 and 57 arranged or located within the casing 52. The washers 56 and 57 are bowl-shaped and positioned with open faces thereof opposite each other with the spring 55 therebetween. The washer 57 has its bottom thrust up against the projection of the rod 54, the washer 56 being against the bottom of the casing 52 and free for rocking motion within the turning plane of the gib 48. For this purpose, the end of the washer 56, facing the bottom of the casing 52, is formed with a diametrically projecting knife-shaped lug 58. The interior portion of the bottom of the casing 52 is formed with a groove 59 extending in the same direction and linearly contacting with the lug 58, such as shown in FIG. 9. Screwed on the end of the rod 54, projecting from the casing 52, are two nuts 60.

The herein proposed automatic forge rolling machine operates as follows.

First, the machine common drive 22 is actuated, said drive comprising an electric motor 61 (FIG. 3) and a flywheel 62 kinematically linked therewith. The preheated workpiece 2 is fed onto the chute (see FIG. 1). Mounted on the first section 9 of the chute is a pick up (not shown) which is operated at the moment when the workpiece 2 passes by to transmit a signal to the gear drive actuated by the machine drive 22 for rotating the roll shaft 5 through a kinematic chain. The roll shaft 5 and kinematically linked therewith shaft 4 are thus set in rotating motion. The workpiece 2 is advanced along the chute and on approaching the means 47 it is braked down before getting to the dies 6 and 7. The gib 48 (FIG. 8) of the braking means 47 is inclined when in its initial position, having its free end down in the chute. The workpiece 2 approaches the gib 48 and is thrust up thereagainst, thereby lifting the latter, such as shown in FIG. 8. The gib 48 is actuated by the spring 55 to press the workpiece 2 against the chute, thus breaking down said work-piece.

Set in motion simultaneously with the shafts 4 and 5 (FIG. 1) is the conveyer 12 kinematically linked with the shaft 5. The pusher 18 is brought to the workpiece 2. The roller 42 (FIG. 7) is thrust up against the end G of the workpiece 2 and guides the latter into the gap S (FIG. 2) between the roll forging dies 6 and 7. The dies 6 and 7 engage the workpiece 2, thereby roll forging it. In the process of roll forging operation the part of the workpiece 2, which has not been yet engaged by the dies 6 and 7 is made to slow down due to partial stretching of the deformed material of the workpiece 2 in the direction opposite to the travel of the workpiece 2. Inasmuch the hauling member 16 (FIG. 1) travels at a constant speed along the straight-line sections of the conveyor 12, the retardation of the end G of the workpiece 2 (FIG. 6) causes displacement of the pusher 18. The position of the pusher 18, depending on a type and size of the workpiece 2, is set by the adjustable stop 44 against which it is spring-biased.

On passing through the last pair of the roll dies 6 and 7, the workpiece 2 is pushed out from the chute by the pusher 18 to be delivered for subsequent processing. Travelling further on, the pusher 18 interacts with the pickup 63 mounted on the frame 13 of the conveyer 12. The pickup 63 transmits a signal which acts to breake the kinematic link between the common drive 22 of the forge machine and the shaft 5. The common drive is brought to a halt and the pusher 18 is brought back to its initial position. Another workpiece 2 is thence fed to the chute 8 and the herein above described operating cycle repeats.

Being exposed to the heat off the hot workpieces in the process of their roll forging, and due to natural wear of the elements of the chain 16 of the conveyer 12, said chain 16 elongates. This chain elongation is compensated for by tensioning said chain 16 with the aid of the mechanism 19. As the chain 16 elongates, the driven sprocket 15 (FIG. 5) of the conveyer 12 is shifted along the conveyer 12 (FIG. 1) under the action of the spring 38 in the direction of the travel of the workpiece 2 being treated. Owing to this, the initial position of the pusher 18 remains unchanged, and as a consequence, feeding of the workpiece 2 to the roll forging dies 6 and 7 is effected at predetermined time intervals.

The compression springs 38 (FIG. 5) are replaced as follows.

The nut 36*a* is unscrewed. The screw 36 is removed from the shaped nut 35 until its end is out of the opening 33. Then, the screw 36 together with the shaped nut 35 is removed from the notch 34*a.* The washer 37 together with the broken compression spring 38 is removed from the opening 33.

A new compression spring 38 is inserted in reverse order.

The compression spring 38 and the washer 37 are fitted into the opening 33. Then the shaped nut 35 and the screw 36 are set into the notch 34*a.* The screw 36 is screwed in the shaped nut 35 so as to create a required compression force of the spring 38, said screw being then locked by the nut 36*a.*

What is claimed is:

1. An automatic forge rolling machine comprising: a bed; stands mounted on said bed; two roll shafts mounted within each said stand and having each one free end; pairs of roll forging dies arranged one above the other on free ends of said roll shafts; a means for feeding a workpiece to said dies; said means being provided with a guideway for the workpiece to travel therealong; a conveyer kinematically associated with one of said roll shafts; a hauling member on the conveyer, said member carrying a pusher for advancing the workpiece along said guide way; means for braking the workpiece, said means being positioned ahead of a pair of said dies; a braking element of said means for braking the workpiece, said element being arranged substantially above said guide way and spring-biased towards the latter; a mechanism for tensioning the conveyer hauling member arranged behind said dies in the direction of the workpiece travel; said tensioning mechanism being made so that the tensioning of the hauling member is maintained constant in the direction of the workpiece travel, thereby providing accuracy of an initial position of the pusher ahead of said means for braking down the workpiece.

2. A machine as claimed in claim 1, wherein the breaking element made as a gib having one end hinged to the machine stand, and a free end thereof being spring-biased towards said guide way.

3. A machine as claimed in claim 1 wherein the conveyer hauling member tensioning mechanism comprises a yoke carrying the conveyer driven member mounted on its frame for reciprocating movement therealong by means of guide rams rigidly fixed to the yoke and having washers at free and thereof; compression springs mounted within the conveyer frame in parallel to said guide rams, each spring having one end thrust up against a yoke face, the other end thrusting up against a screw means, a shaped nut threaded on said screw means loosely set in a slot formed in the conveyer frame, said slot being perpendicular to the axes of the guide rams.

* * * * *